US008459051B2

(12) United States Patent
Jeong et al.

(10) Patent No.: US 8,459,051 B2
(45) Date of Patent: Jun. 11, 2013

(54) AIR CONDITIONER AND METHOD OF CONTROLLING THE SAME

(75) Inventors: Ho Jong Jeong, Seoul (KR); Chi Woo Song, Seoul (KR); Baik Young Chung, Seoul (KR); Sai Kee Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 610 days.

(21) Appl. No.: 12/710,886

(22) Filed: Feb. 23, 2010

(65) Prior Publication Data

US 2010/0212342 A1 Aug. 26, 2010

(30) Foreign Application Priority Data

Feb. 25, 2009 (KR) ..... 10-2009-0015927

(51) Int. Cl.
*F25B 49/00* (2006.01)
*F25B 41/04* (2006.01)

(52) U.S. Cl.
USPC ..... 62/196.1; 62/225; 62/513

(58) Field of Classification Search
USPC ..... 62/113, 196.1, 197, 225, 513
See application file for complete search history.

(56) References Cited

U.S. PATENT DOCUMENTS

| | | | | |
|---|---|---|---|---|
| 4,938,029 | A | 7/1990 | Shaw | |
| 6,474,087 | B1 | 11/2002 | Lifson | |
| 7,997,092 | B2 * | 8/2011 | Lifson et al. | 62/115 |
| 2003/0010046 | A1 | 1/2003 | Freund et al. | |
| 2006/0064997 | A1 * | 3/2006 | Grabon | 62/197 |
| 2009/0044550 | A1 | 2/2009 | Nishimura et al. | |

FOREIGN PATENT DOCUMENTS

| | | | |
|---|---|---|---|
| EP | 0 778 451 | A2 | 6/1997 |
| EP | 1 225 400 | A1 | 7/2002 |
| EP | 1 908 958 | A2 | 4/2008 |
| JP | 61-174295 | | 8/1986 |
| JP | 2-309157 | | 12/1990 |
| JP | 09-210480 | A | 8/1997 |
| JP | 2000-018737 | A | 1/2000 |
| JP | 2000-234811 | A | 8/2000 |
| JP | 2007-255864 | A | 10/2007 |

* cited by examiner

*Primary Examiner* — Marc Norman

(74) *Attorney, Agent, or Firm* — McKenna Long & Aldridge LLP

(57) ABSTRACT

An air conditioner includes a compressor, a first heat exchanger, and a first pipe configured to allow refrigerant to flow from the first heat exchanger. A bypass pipe is branched off from the first pipe and is configured to expand refrigerant flowing through the bypass pipe. A second heat exchanger is configured to allow the expanded refrigerant of the bypass pipe to heat-exchange with the refrigerant flowing along the first pipe. A second pipe couples the second heat exchanger to the compressor so that the refrigerant expanded by the bypass pipe and heat-exchanged at the second heat exchanger can be introduced into the compressor.

15 Claims, 6 Drawing Sheets

AIR CONDITIONER AND METHOD OF CONTROLLING THE SAME

This application claims priority from Korean Patent Application No. 10-2009-0015927 filed on Feb. 25, 2009, in the Korean Intellectual Property Office, the disclosure of which is incorporated herein by reference in its entirety.

BACKGROUND

1. Field of the Disclosure

The present disclosure relates to an air conditioner, and more particularly, to an air conditioner that is configured to increase an amount of refrigerant that is compressed by a compressor in a heating mode.

2. Description of the Related Art

Generally, an air conditioner is an appliance that cools or heats indoor air by heat-exchange of refrigerant with the indoor air using a refrigeration cycle for compressing, condensing, expanding, and vaporizing the refrigerant. The air conditioners are classified into cooling air conditioners that supply cool air to an indoor space by operating the refrigeration cycle in only one direction and heating-and-cooling air conditioners that can supply cool or hot air by selectively operating the refrigeration cycle in one of both directions.

The heating-and-cooling air conditioner heats an indoor space when the refrigerant compressed by a compressor flows into an indoor heat exchanger provided in an indoor unit and is condensed by heat-exchanging with indoor air. The condensed refrigerant expands at an expansion valve and is vaporized by heat-exchanging with outdoor air at an outdoor heat exchanger provided in an outdoor unit. The vaporized refrigerant flows into the compressor and is compressed by the compressor. The compressed refrigerant flows toward the indoor heat exchanger, thereby continuously realizing a heating cycle.

At this point, as the outdoor temperature is reduced, the expansion and vaporization capabilities of the refrigerant passing through the outdoor heat exchanger deteriorates and thus the efficiency of the compressor compressing the refrigerant also deteriorates. Accordingly, the heating capability is deteriorated. This causes discomfort to the user.

BRIEF SUMMARY

Accordingly, the present disclosure is directed to an air conditioner and method of controlling the air conditioner that substantially obviate one or more problems due to limitations and disadvantages of the related art.

An object of the present disclosure relates to an air conditioner that can improve heating capability by increasing an amount of refrigerant compressed by a compressor.

Another object of the present disclosure relates to an air conditioner that can highly maintain a heating increase rate even in a very low outdoor temperature environment.

Additional advantages, objects, and features of the air conditioner will be set forth in part in the description which follows and in part will become apparent to those having ordinary skill in the art upon examination of the following disclosure or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, there is provided an air conditioner including a compressor, a first heat exchanger, and a first pipe configured to allow refrigerant to flow from the first heat exchanger. A bypass pipe is branched off from the first pipe and is configured to expand refrigerant flowing through the bypass pipe. A second heat exchanger is configured to allow the expanded refrigerant of the bypass pipe to heat-exchange with the refrigerant flowing along the first pipe. A second pipe couples the second heat exchanger to the compressor so that the refrigerant expanded by the bypass pipe and heat-exchanged at the second heat exchanger can be introduced into the compressor.

In another aspect, there is provided a control method of an air conditioner, the method including measuring a degree of discharge superheat of a compressor, expanding a portion of refrigerant that is branched off from refrigerant that flows from an indoor heat exchanger into an outdoor heat exchanger, heat-exchanging the expanded portion of the refrigerant with the refrigerant that flows towards the outdoor heat exchanger, and introducing the heat-exchanged portion of the refrigerant into the compressor, when a degree of discharge superheat is above a first predetermined value.

It is to be understood that both the foregoing general description and the following detailed description are exemplary and explanatory and are not intended to limit the scope of the claims.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION

Figure 1:
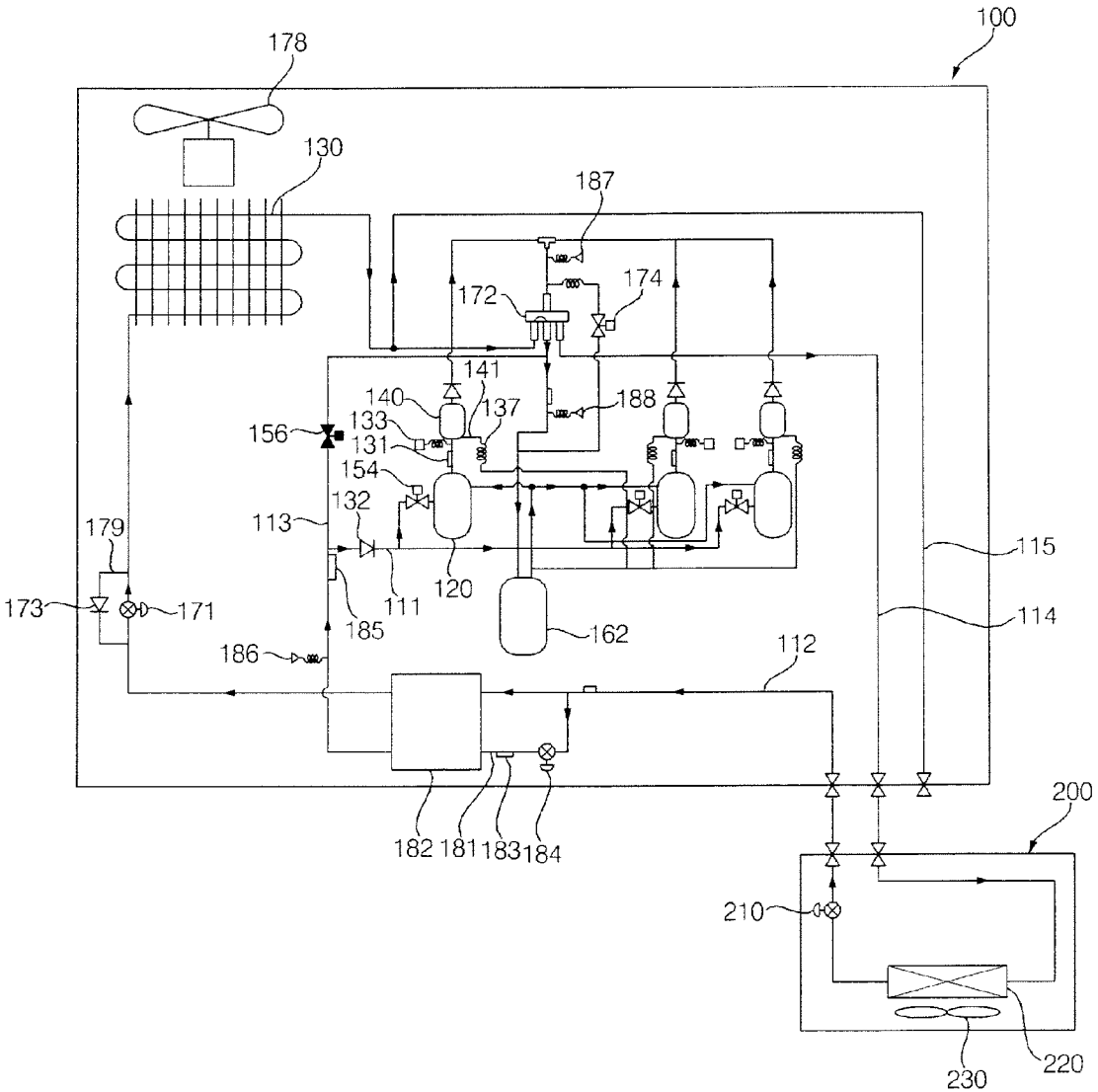
FIG. 1 is a schematic view of an air conditioner in a heating mode according to an embodiment of the present invention.

Advantages and features, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete. Like reference numerals refer to like elements throughout.

Figure 2:
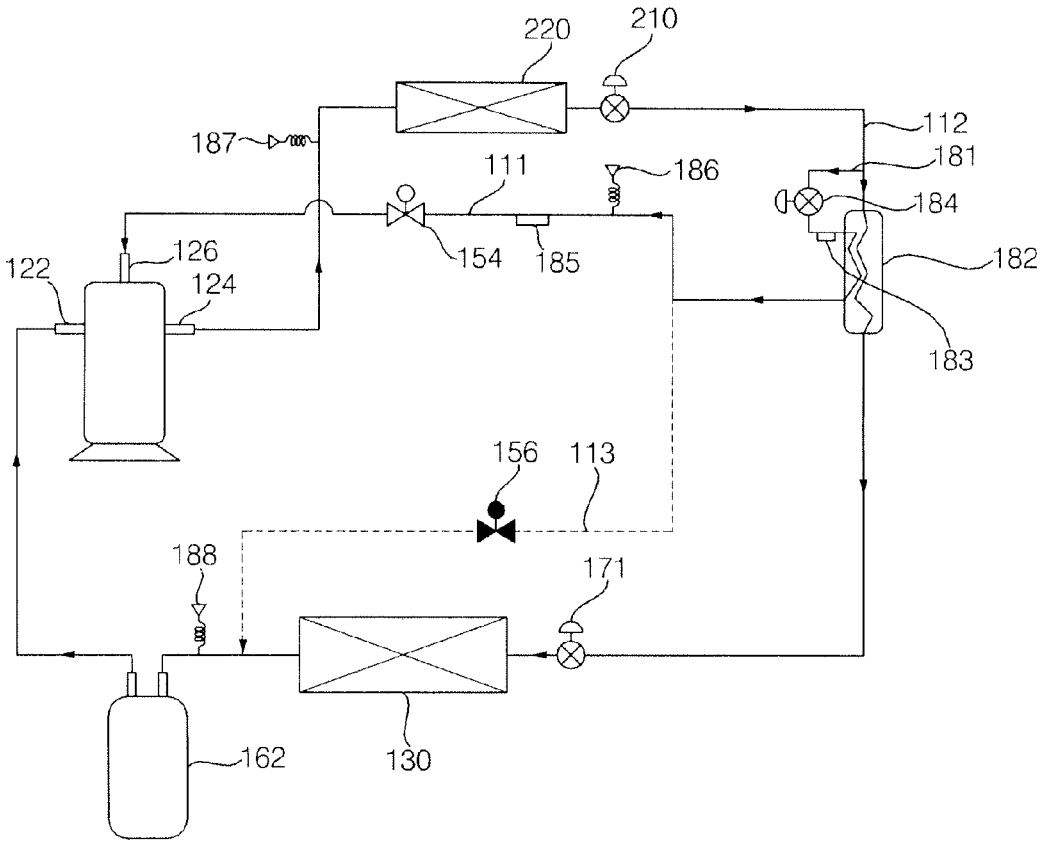
FIG. 2 is a schematic diagram of the air conditioner of FIG. 1, illustrating flow of refrigerant in the heating mode.

FIG. 1 is a schematic view of an air conditioner in a heating mode according to an embodiment of the present invention and FIG. 2 is a schematic diagram of the air conditioner of FIG. 1, illustrating flow of refrigerant in the heating mode. An embodiment of the present invention will be described hereinafter with reference to FIGS. 1 and 2.

An air conditioner according to an embodiment of the present invention includes an outdoor unit 100 and an indoor unit 200. Although one outdoor unit 100 and one indoor unit 200 are illustrated in the drawings, this should not be construed as a limitation. That is, the air conditioner may include a plurality of outdoor units 100 and/or a plurality of indoor units 200. When a plurality of outdoor units 100 are provided and interconnected, a high/low pressure common pipe 115 may be further provided to equalize the high pressure or low pressure refrigerant between the outdoor units 100.

The outdoor unit 100 includes a compressor 120, an outdoor heat exchanger 130, and an internal heat exchanger 182. Although three compressors 120 are illustrated in this embodiment, this should not be construed as a limitation. The number of compressors may vary depending on an air conditioning load and compression capacity of the air conditioner.

The compressor 120 includes an intake port 122 through which the refrigerant vaporized by the outdoor heat exchanger 130 flows into the compressor 120, a discharge port 124 through which the compressed refrigerant is discharged, and an injection port 126 through which the refrigerant that is in an intermediate pressure state is injected from the internal heat exchanger 182 side.

The compressor 120 compresses low temperature/low pressure refrigerant into high temperature/high pressure refrigerant. The compressor 120 may be variously structured. For example, an inverter type compressor or a constant speed compressor may be used as the compressor 120. An accumulator 162 may be provided to prevent the liquid-phase refrigerant from flowing into the compressor 120. A temperature sensor 131 for measuring a temperature of the refrigerant discharged by the compressor 120 and a pressure switch 133 for adjusting discharge pressure of the refrigerant are provided.

Oil contained in the refrigerant discharged by the compressor 120 is separated from the refrigerant by an oil separator 140 and the separated oil flows along the oil recovery pipe 141 and is mixed with the gas-phase refrigerant separated from the accumulator 162, after which the oil flows into the compressor 120. A capillary tube 137 may be provided in the oil recovery pipe 141.

Meanwhile, some of the refrigerant discharged by the compressor is returned to the compressor 120 through a hot gas valve 174.

A four-way valve 172 that is a directional control valve functions to guide the refrigerant compressed in the compressor 120 to the outdoor heat exchanger 130 in a cooling mode and to the indoor heat exchanger 220 in a heating mode.

The outdoor heat exchanger 130 is generally disposed outdoor. The refrigerant heat-exchanges with the outdoor air while passing through the outdoor heat exchanger 130. The outdoor heat exchanger 130 functions as a condenser in the cooling mode and as a vaporizer in the heating mode. The outdoor expansion valve 171 expands the refrigerant directed toward the outdoor heat exchanger 130 in the heating mode. A blower fan 178 may be provided to discharge heat generated by the heat-exchange between the outdoor air and the refrigerant flowing along the outdoor heat exchanger 178 external to the outdoor unit 100.

In the heating mode, the refrigerant condensed by the indoor heat exchanger 220 flows into the internal heat exchanger 182 through a liquid pipe 112. At this point, some of the refrigerant flowing along the liquid pipe 112 is directed to the bypass pipe 181 and expands while passing through an internal expansion valve 184 provided on the bypass pipe 181, after which the expanded refrigerant flows into the internal heat exchanger 182. At this point, heat exchange between the refrigerant from the liquid pipe 112 and the refrigerant from the bypass pipe 181 is realized at the internal heat exchanger 182. Here, the refrigerant flowing from the liquid pipe 112 to the internal heat exchanger 182 has the higher temperature than the refrigerant flowing toward the bypass pipe 181 and expanded by the internal expansion valve 184. Therefore, the expanded refrigerant absorbs the heat to be vaporized. The vaporized refrigerant is transferred to the compressor 120 through a first refrigerant pipe 111. A first temperature sensor 185 for measuring a temperature of the refrigerant injected toward the compressor 120 is provided. The first temperature sensor 185 may be provided on the first refrigerant pipe 111.

Although there is a variety of types of internal expansion valve 184, a linear expansion valve may be used as the internal expansion valve 184 considering convenience in use and control.

A first refrigerant adjusting valve 154 for controlling the refrigerant injected to the compressor 120 through the first refrigerant pipe 111 may be provided. The first refrigerant control valve 154 is controlled to be opened when degree of discharge superheat of the compressor is above a first predetermined value.

The degree of superheat means a difference between a temperature of vaporized gas superheated above a saturated temperature and a saturated temperature corresponding to the pressure. The degree of discharge superheat of the compressor means a degree of superheat of the refrigerant discharged through a discharge port 124 of the compressor 120.

The degree of discharge superheat may be measured in various ways. For example, it is possible to measure the degree of discharge superheat of the compressor 120 by detecting the discharge pressure and temperature of the compressor 120, which can be easily measured, and using a pressure-temperature curve corresponding to the detected discharge pressure and temperature. It is also possible to measure the degree of discharge superheat of the compressor by measuring a discharge temperature of the compressor 120 and a temperature of the refrigerant vaporized in the outdoor heat exchanger 130.

The first predetermined value is a value for stable operation of the compressor 120. When the degree of discharge superheat of the compressor 120 is too low, the liquid-phase refrigerant may flow into the compressor 120. This may be hard on the compressor 120 and may cause noise to be generated. On the other hand, when the degree of discharge superheat of the compressor 120 is too high, the compressor 120 may be overheated and the efficiency of the compressor 120 may be deteriorated. Therefore, it is preferable that the first predetermined value is set considering these characteristics.

Meanwhile, a second refrigerant pipe 113 may be further provided so that the refrigerant flowing into the internal heat exchanger 182 through the bypass pipe 181 and heat-exchanged at the internal heat exchanger 182 can be transferred to the accumulator 162 in the cooling mode. A second refrigerant adjusting valve 156 may be provided on the second refrigerant pipe 113. The second refrigerant adjusting valve 156 may be controlled to be closed in the heating mode.

The refrigerant flowing from the liquid pipe 112 to the internal heat exchanger 182 heat-exchanges with the refrigerant flowing along the bypass pipe 181, after which the refrigerant is discharged toward the outdoor heat exchanger 130. The refrigerant discharged toward the outdoor heat exchanger 130 expands while passing through the refrigerant expansion valve 171 before flowing into the outdoor heat exchanger 130.

The refrigerant expanded by the refrigerant expansion valve 171 heat-exchanges while passing through the outdoor heat exchanger 130. At this point, it is preferable that the refrigerant is completely vaporized in the outdoor heat exchanger 130. However, the refrigerant may not be completely vaporized in the outdoor heat exchanger 130 due to a variety of conditions such as a temperature of outdoor air, pressure of the refrigerant, and temperature of the refrigerant. As a result, the refrigerant may exist in a state where liquid-phase refrigerant and gas-phase refrigerant are mixed with each other. The mixed refrigerant (the liquid-phase refrigerant and the gas-phase refrigerant) is separated into the gas-phase refrigerant and the liquid-phase refrigerant in the accumulator 162. At this point, the gas-phase refrigerant is returned to the compressor 120.

In the above-described process, the refrigerant injected through the first refrigerant pipe 111 and the refrigerant from the accumulator 162 are compressed together in the compressor 120. Therefore, a sufficient amount of the refrigerant being compressed can be attained and thus there is an effect that the heat efficiency can be improved.

In addition, when a temperature of the outdoor air is low, the refrigerant may not be sufficiently vaporized in the outdoor heat exchanger 130 and thus both the gas-phase refrigerant and the liquid-phase refrigerant may be mixed and flow into the accumulator 162. The gas-phase refrigerant is separated in the accumulator 162 and flows into the compressor 120. Therefore, there was a problem that an amount of the gas-phase refrigerant flowing into the compressor 120 is reduced. However, in this embodiment, not only is there refrigerant heat-exchanging while passing through the outdoor heat exchanger 130 but also there is the refrigerant heat-exchanging in the internal heat exchanger 182, which flows into the compressor 120. Thus, a sufficient amount of the refrigerant flowing into the compressor 120 can be attained even when the temperature of the outdoor air is low.

Meanwhile, the air conditioner may further include a first temperature sensor 185 for measuring a temperature of refrigerant flowing along the first refrigerant pipe 111 and a second temperature sensor 183 for measuring the refrigerant flowing into the internal heat exchanger 182 through the bypass pipe 181. At this point, the second temperature sensor 183 may be provided between the internal heat exchanger 182 and the internal expansion valve 184.

The degree of superheat (hereinafter, referred to as "degree of injection superheat") of the refrigerant injected into the compressor 120 can be represented by a difference between a temperature measured by the first temperature sensor 185 and a temperature measured by the second temperature sensor 183. An opening of the internal expansion valve 184 is adjusted such that the degree of injection superheat reaches a second predetermined value.

The second predetermined value is set such that the degree of injection superheat can be sufficiently attained. The second predetermined value may be properly set considering the temperature of the outdoor air, performance of the compressor, endurance of the compressor and set value of the indoor temperature.

Meanwhile, the second predetermined value may be set to keep the degree of discharge superheat of the compressor 120 above the first predetermined value. The degree of discharge superheat of the compressor 120 may be lowered by a variety of conditions such as variation of outdoor temperature, the outdoor heat exchanger 130 in a low temperature environment, and freezing caused by the heat exchange in the outdoor heat exchanger 130 and internal heat exchanger 182. In order to compensate for the degree of discharge superheat of the compressor 120, the second predetermined value can be properly set to keep the degree of discharge superheat of the compressor above the first predetermined value, thereby improving the heat performance and attaining the stability of the system.

The second predetermined value may be set considering the temperature of the outdoor air. When the temperature of the outdoor air is low, for example, in the winter season, the general performance of the system deteriorates and thus the degree of discharge superheat of the compressor 120 is lowered. In order to solve this limitation, the second temperature should be set high.

Meanwhile, the indoor unit 200 may include an indoor expansion valve 210, an indoor heat exchanger 220, and an indoor blower fan 230 directing the heat-exchanged air toward the indoor space. The indoor expansion valve 210 is a device for expanding the refrigerant in the cooling mode. Although there is a variety of types of expansion valves, a linear expansion valve may be used as the indoor expansion valve 210 considering convenience in use and control. An opening of the indoor expansion valve 210 may be differently adjusted depending on whether it is in a cooling mode and in a heating mode.

Figure 3:
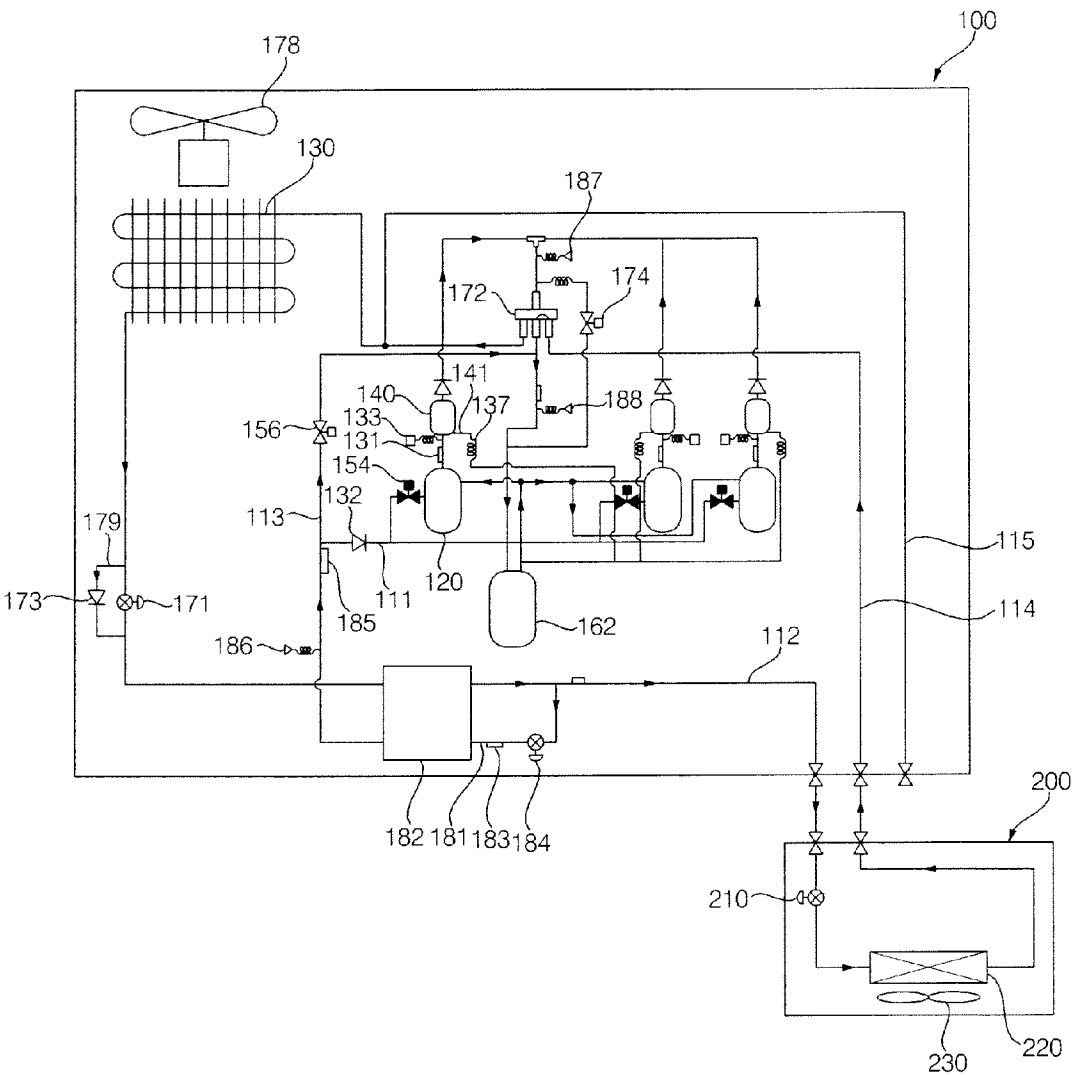
FIG. 3 is a schematic diagram of an air conditioner in a cooling mode according to an embodiment of the present invention.
Figure 4:
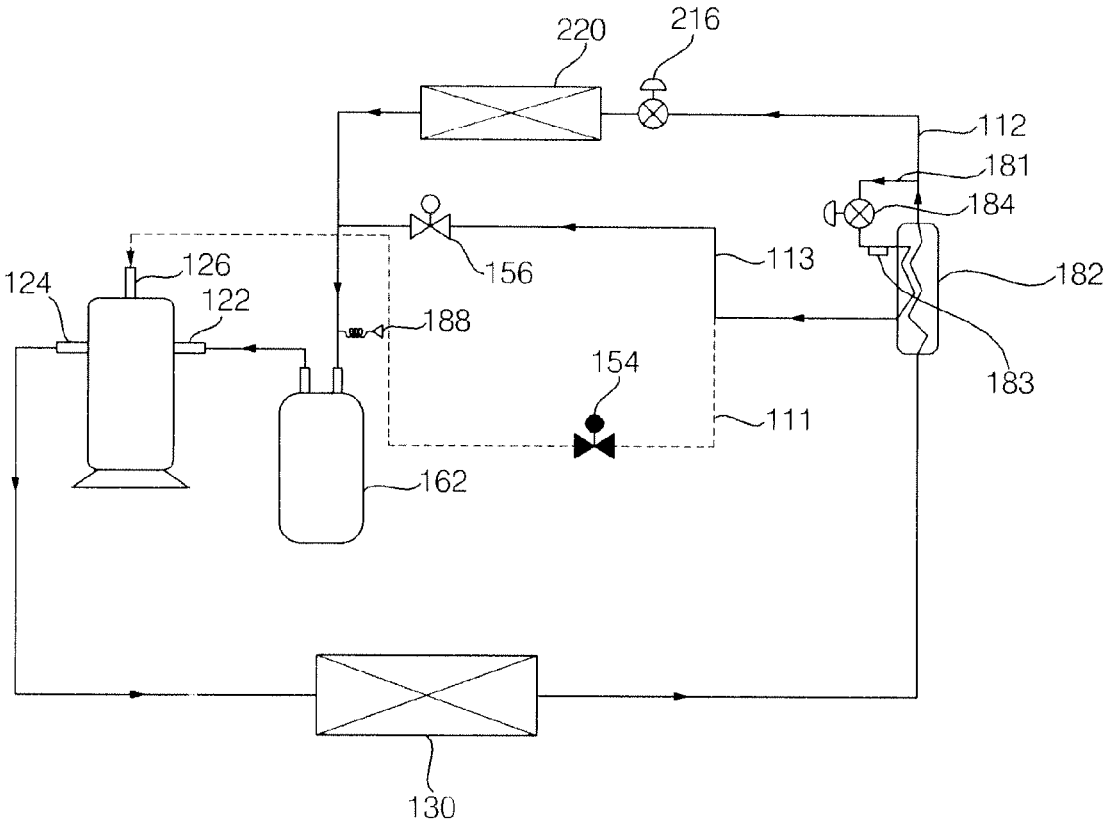
FIG. 4 is a schematic diagram of the air conditioner of FIG. 3, illustrating flow of refrigerant in the cooling mode.

FIG. 3 is a schematic diagram of an air conditioner in a cooling mode according to an embodiment of the present invention and FIG. 4 is a schematic diagram of the air conditioner of FIG. 3, illustrating flow of refrigerant in the cooling mode. The flow of the refrigerant in the cooling mode will be described hereinafter with reference to FIGS. 3 and 4.

The high temperature/high pressure gas-phase refrigerant discharged from the compressor 120 flows into the outdoor heat exchanger 130 via the four-way valve 172. In the outdoor heat exchanger 130, the refrigerant is condensed by heat-exchanging with the outdoor air. The refrigerant passing through the outdoor heat exchanger 130 does not flow into the refrigerant expansion valve 171 but is input to the internal heat exchanger 171 by detouring around the refrigerant expansion valve 171 through the refrigerant pipe 179. The refrigerant introduced into the internal heat exchanger 182 heat-exchanges and is then discharged to the liquid pipe 112.

Some of the refrigerant discharged from the internal heat exchanger 182 to the liquid pipe 112 flows into the bypass pipe 181, expands by the internal expansion valve 184, and is returned to the heat exchanger 182. At this point, the refrigerant input from the outdoor heat exchanger 130 along the liquid pipe 112 and the refrigerant input through the bypass pipe 181 heat-exchange with each other in the internal heat exchanger 182. At this point, since the refrigerant flowing from the bypass pipe 181 into the internal heat exchanger 182 is in an expanded state caused by the internal expansion valve 184, this refrigerant has the lower temperature than the refrigerant flowing from the outdoor heat exchanger 130. Therefore, the refrigerant from the outdoor heat exchanger 130 is further cooled and then input to the indoor heat exchanger 220.

The refrigerant that is input from the bypass pipe 181 to the internal heat exchanger 182 and heat-exchanged is transferred to the accumulator 162 through the second refrigerant pipe 113. The liquid-phase refrigerant is removed from the refrigerant in the accumulator 162 and the refrigerant from which the liquid-phase refrigerant is removed is introduced into the compressor 120. At this point, the second refrigerant adjusting valve 156 may be provided on the second refrigerant pipe 113 and controlled to be opened in the cooling mode. At this point, the first refrigerant adjusting valve 154 provided on the first refrigerant adjusting valve 154 may be closed. A check valve 132 for preventing the refrigerant from flowing toward the compressor 120 may be provided on the first refrigerant pipe 111.

Meanwhile, the refrigerant flowing from the internal heat exchanger 182 to the liquid pipe 112 flows into the indoor unit 200 and is expanded by the indoor expansion valve 210, after which the refrigerant heat-exchanges at the indoor heat exchanger 220 and is then introduced into the compressor via the gas pipe 114, four-way valve 172, and accumulator 162 to continuously realize the cooling cycle.

Figure 5:
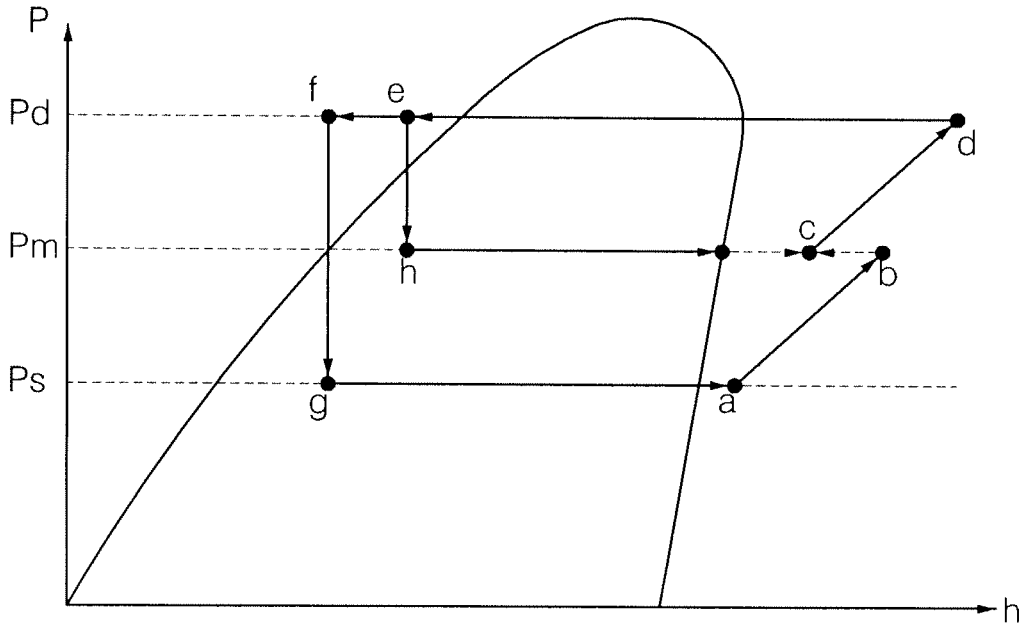
FIG. 5 is a P-h diagram illustrating variation in enthalpy and pressure of refrigerant circulating an air conditioner according to an embodiment of the present invention.

FIG. 5 is a P-h diagram illustrating variation in an enthalpy and pressure of refrigerant circulating in an air conditioner according to an embodiment of the present invention. Referring to FIG. 5, the refrigerant flowing into the compressor 120 through the intake port 122 is compressed while varying in a phase thereof along "a-b" in the P-h diagram.

Meanwhile, the gas-phase refrigerant that heat-exchanged in the internal heat exchanger 182 is further injected into the compressor 120 through the injection port 126. At this point, the refrigerant flowing into the compressor 120 through the intake port 122 and the refrigerant injected through the injection port 126 are compressed together in the compressor 120. This process can be represented as a phase variation process along "c-d" in the P-h diagram.

The refrigerant compressed by the compressor 120 and discharged from the compressor 120 flows into the indoor unit 200 and is condensed by heat-exchanging in the indoor heat exchanger 220. At this point, the phase of the refrigerant varies along "d-e" in the P-h diagram.

The refrigerant input to the internal heat exchanger 182 through the liquid pipe 112 after heat-exchanging in the indoor heat exchanger 220 heat-exchanges with the refrigerant flowing along the bypass pipe 181. This process can be represented as a phase variation process along "e-f" in the P-h diagram.

The refrigerant output from the internal heat exchanger 182 to the outdoor heat exchanger 130 expands while passing through the refrigerant expansion valve 171. This process can be represented as a phase variation process along "f-g" in the P-h diagram.

In addition, the refrigerant expanded by the refrigerant expansion valve 171 is input to the outdoor heat exchanger 130 and vaporized by heat-exchanging with the outdoor air. This process can be represented as a phase variation process along "g-a" in the P-h diagram.

Meanwhile, the refrigerant flowing into the bypass pipe 181 from the liquid pipe 112 expands while passing through the internal expansion valve 184. This process can be represented as a phase variation process along "e-h" in the P-h diagram.

The refrigerant expanded by the internal expansion valve 184 is input again to the internal heat exchanger 182, after which the refrigerant is vaporized while heat-exchanging with the refrigerant input from the liquid pipe 112 to the internal heat exchanger 182. This process can be represented as a phase variation process along "h-c" in the P-h diagram.

According to the embodiment of the present invention, since the refrigerant vaporized by heat-exchanging in the internal heat exchanger 182 is additionally injected into the compressor 120 and compressed by the compressor 120, much more refrigerant is compressed and thus the heating energy increases. In addition, a whole amount of energy (an amount proportional to an area defined by "a-b-c-d-e-f-g-a" in the P-h diagram) used for general heating increases by a process ("e-f" in the P-h diagram) where the refrigerant flowing from the liquid pipe 112 to the internal heat exchanger 182 is condensed while heat-exchanging with the refrigerant input to the internal heat exchanger 182 through the bypass pipe 181.

As the whole amount of the energy increases as described above, the heating increase rate is improved. The heating increase rate can be defined by a ratio between Pd−Pm and Pd−Ps as follows:

$$n=(Pd-Pm)/(Pd-Ps);$$

where, Pd is pressure of the refrigerant discharged by the compressor 120, which can be measured by a pressure sensor 187 measuring pressure at an front end of the discharge port 124, Pm is pressure of the refrigerant flowing into the compressor 120 through the injection port 126, which can be measured by a pressure sensor 186 provided on the first refrigerant pipe 111, and Ps is pressure introduced into the intake port 122, which can be measured by a pressure sensor 188.

There is a need to properly adjust pressures Pd, Pm, and Ps to improve the heat increasing rate (n). In order to adjust the discharge pressure (Pd) of the compressor 120, a pressure adjusting unit may be provided near the discharge port 124 of the compressor 120. In this embodiment, a pressure switch 133 may be provided on the front end of the discharge port 124 of the compressor as the pressure adjusting unit. In addition, a pressure switch (not shown) may be provided on the first refrigerant pipe 111 to adjust the pressure Pm of the refrigerant injected to the compressor 120 through the injection port 126. An additional pressure switch (now shown) may be provided to adjust the pressure of the refrigerant flowing into the compressor 120 through the intake port 122.

Meanwhile, it is also possible to adjust the opening of the internal expansion valve 184 to maintain the heat increasing rate (n) within a predetermined range. That is, by adjusting the opening of the internal expansion valve 184, the degree of superheat of the refrigerant injected into the compressor 120 through the injection port 126 can be controlled and thus the heating increase rate (n) determined by the pressures Pd, Ps, and Pm that vary in response to the degree of superheat of the refrigerant.

Figure 6:
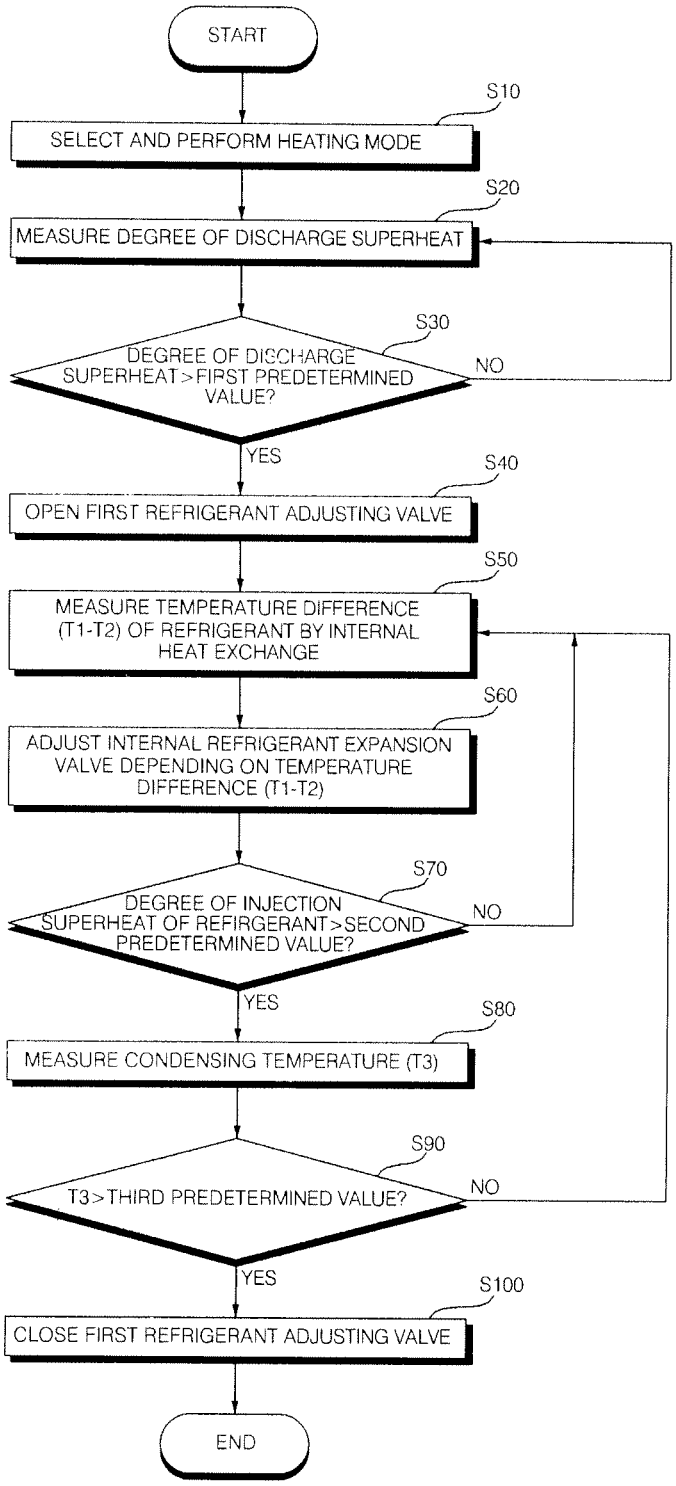
FIG. 6 is a flowchart illustrating an exemplary control method of an air conditioner according to an embodiment of the present invention.

FIG. 6 is a flowchart illustrating an exemplary control method of an air conditioner according to an embodiment of the present invention, which may be performed by a controller.

When a user selects the heating mode, the heating mode operation is performed (S10).

After the heating mode operation is performed for a predetermined time, the degree of discharge superheat of the compressor 120 is measured (S20). At this point, the predetermined time is a time for which the system can be stabilized. That is, when the degree of discharge superheat of the compressor 120 is too low, the refrigerant flowing into the compressor 120 may contain the liquid-phase refrigerant. This may cause operational noise to be generated. The operational noise may cause user complaint. On the other hand, when the degree of discharge superheat of the compressor 120 is too high, the compressor 120 may burn out. Therefore, the predetermined time may be set considering the above-described characteristics.

After the above, it is determined if the degree of discharge superheat is above a first predetermined value (S30). The first predetermined value may be set considering the above-described characteristics for the stability of the system.

When the degree of discharge superheat is above the first predetermined value, the first refrigerant adjusting valve 154 is opened to allow for a refrigerant passage from the internal heat exchanger 182 to the compressor 120 (S40). At this point, some of the refrigerant input from the indoor heat exchanger 220 to the internal heat exchanger 182 along the liquid pipe 112 is branched off to the bypass pipe 181 and expands while passing through the internal expansion valve 184.

The expanded refrigerant heat-exchanges with the rest of the refrigerant input to the internal heat exchanger 182 along the liquid pipe 112. At this point, the refrigerant vaporized by the heat exchange is injected into the compressor 120 through the injection port 126 along the first refrigerant pipe 111.

While the refrigerant is directed to the compressor 120 as described above, the first and second temperature sensors 185 and 183 measure a first temperature T1 injected to the compressor 120 and a temperature T2 expanded by the internal expansion valve 184 and input to the internal heat exchanger 182 to measure the degree of injection superheat, respectively (S50).

The opening of the internal expansion valve 184 is adjusted in accordance with the degree of discharge superheat and/or degree of injection superheat of the compressor 120 (S60). Next, the degree of injection superheat is compared with a second predetermined value (S70). When the degree of injection superheat is lower than the second predetermined value, the opening of the internal expansion valve 184 is adjusted again to make the degree of injection superheat higher than the second predetermined value.

On the other hand, when the injection superheat is higher than the second predetermined value, a condensing temperature (T3) of the refrigerant flowing into the compressor 120 is measured (S80). Here, the condensing temperature may be a temperature for condensing the refrigerant in the indoor heat exchanger 220. When it is determined that the condensing temperature (T3) is above a third predetermined value, it is determined that the system stability is attained and thus the first refrigerant adjusting valve 154 is closed (S100) so that the refrigerant cannot be injected into the compressor 20 any more.

On the other hand, when it is determined that the condensing temperature (T3) is less than the third predetermined value, the temperatures (T1 and T2) are measured again (S50) to continuously control the degree of injection superheat.

Meanwhile, there is no need to limit the condensing temperature (T3) to the condensing temperature in the indoor heat exchanger 220. The condensing temperature (T3) is a reference temperature by which it is determined if the system is stabilized to a state where no refrigerant injection is required any more. Therefore, the condensing temperature (T3) may be set based on a condensing temperature in the internal heat exchanger 182.

Meanwhile, the second predetermined value is a value affecting on the degree of discharge superheat of the compressor. For example, when the second predetermined value is set to be relatively high, the system is controlled in a direction where the degree of injection superheat increases. Therefore, the second predetermined value may be set to maintain the degree of discharge superheat of the compressor above the first predetermined value. In this case, when the degree of injection superheat is above the second predetermined value by adjusting the opening of the internal expansion valve 184, the degree of discharge superheat will be also above the first predetermined value consequently.

Meanwhile, the pressure of the refrigerant discharged by the compressor 120 may be adjusted such that the heating increase rate (n) that is a ratio between a difference between the pressure Pd of the refrigerant discharged by the compressor 120 and the pressure Ps of the refrigerant introduced into the compressor and a difference between the pressure Pd of the refrigerant discharged by the compressor 120 and the pressure Ps of the refrigerant injected to the compressor 120 can be within a predetermined range. The pressure of the refrigerant discharged by the compressor 120 can be adjusted by the pressure switch 133.

In another way, the heating increase rate (n) may be controlled by adjusting the opening of the internal expansion valve 184. That is, the pressures Pd, Pm, and Ps that vary by adjustment of the opening of the internal expansion valve 184 are detected and the opening of the internal expansion valve 184 is corrected in accordance with the detected pressures Pd, Pm, and Ps, thereby controlling the heating increase rate (n) within the predetermined range.

It will be apparent to those skilled in the art that various modifications and variations can be made. Thus, it is intended that the modifications and variations are covered by the appended claims and their equivalents.

What is claimed is:

1. An air conditioner comprising:

a compressor;

a first heat exchanger;

a first pipe configured to allow refrigerant to flow from the first heat exchanger;

a bypass pipe branched off from the first pipe and configured to expand refrigerant flowing through the bypass pipe;

a second heat exchanger configured to allow the expanded refrigerant of the bypass pipe to heat-exchange with the refrigerant flowing along the first pipe;

a second pipe that couples the second heat exchanger to the compressor so that the refrigerant expanded by the bypass pipe and heat-exchanged at the second heat exchanger can be introduced into the compressor;

an adjusting valve is provided on the second pipe and is opened when a degree of discharge superheat of the expanded refrigerant introduced to the compressor is above a first predetermined valve; and an expansion valve is provided on the bypass pipe, wherein an opening of the expansion valve is adjusted to maintain the degree of discharge superheat above the first predetermined value, the air conditioner further comprising:

a first temperature sensor measuring a temperature of the expanded refrigerant introduced to the compressor; and a second temperature sensor measuring a temperature of the refrigerant flowing into the second heat exchanger through the bypass pipe, wherein the opening of the expansion valve is adjusted such that a degree of superheat that corresponds to a difference value between the temperature measured by the first temperature sensor and the temperature measured by the second temperature sensor reaches a second predetermined value.

2. The air conditioner according to claim 1, wherein the second predetermined value is set such that the degree of discharge superheat maintains the first predetermined value or is higher than the first predetermined value.

3. The air conditioner comprising:

a compressor;

a first heat exchanger;

a first pipe configured to allow refrigerant to flow from the first heat exchanger;

a bypass pipe branched off from the first pipe and configured to expand refrigerant flowing through the bypass pipe;

a second heat exchanger configured to allow the expanded refrigerant of the bypass pipe to heat-exchange with the refrigerant flowing along the first pipe;

a second pipe that couples the second heat exchanger to the compressor so that the refrigerant expanded by the bypass pipe and heat-exchanged at the second heat exchanger can be introduced into the compressor;

an adjusting valve is provided on the second pipe and is opened when a degree of discharge superheat of the expanded refrigerant introduced to the compressor is above a first predetermined valve; and an expansion valve is provided on the bypass pipe, wherein an opening of the expansion valve is adjusted based on a heating increase rate that corresponds to a ratio between a difference between the pressure of the refrigerant discharged by the compressor and the pressure of the refrigerant introduced into the compressor and a difference between the pressure of the refrigerant discharged by the compressor and the pressure of the expanded refrigerant introduced to the compressor.

4. The air conditioner according to claim 3, wherein the expansion valve is adjusted such that the heating increase rate is within a predetermined range.

5. The air conditioner comprising:

a compressor;

a first heat exchanger;

a first pipe configured to allow refrigerant to flow from the first heat exchanger;

a bypass pipe branched off from the first pipe and configured to expand refrigerant flowing through the bypass pipe;

a second heat exchanger configured to allow the expanded refrigerant of the bypass pipe to heat-exchange with the refrigerant flowing along the first pipe;

a second pipe that couples the second heat exchanger to the compressor so that the refrigerant expanded by the bypass pipe and heat-exchanged at the second heat exchanger can be introduced into the compressor;

an adjusting valve is provided on the second pipe and is opened when a degree of discharge superheat of the expanded refrigerant introduced to the compressor is above a first predetermined valve; and a pressure switch to adjust pressure of the refrigerant discharged from the compressor, wherein the pressure switch adjusts the pressure of the refrigerant discharged by the compressor depending on a heating increase rate that corresponds to a ratio between a difference between the pressure of the refrigerant discharged by the compressor and the pressure of the refrigerant introduced into the compressor and a difference between the pressure of the refrigerant discharged by the compressor and the pressure of the expanded refrigerant introduced to the compressor.

6. The air conditioner according to claim 5, wherein the pressure of the refrigerant discharged by the compressor is adjusted by the pressure switch such that the heating increase rate can be within a predetermined range.

7. The air conditioner comprising:

a compressor;

a first heat exchanger;

a first pipe configured to allow refrigerant to flow from the first heat exchanger;

a bypass pipe branched off from the first pipe and configured to expand refrigerant flowing through the bypass pipe;

a second heat exchanger configured to allow the expanded refrigerant of the bypass pipe to heat-exchange with the refrigerant flowing along the first pipe;

a second pipe that couples the second heat exchanger to the compressor so that the refrigerant expanded by the bypass pipe and heat-exchanged at the second heat exchanger can be introduced into the compressor; and an adjusting valve is provided on the second pipe and is opened when a degree of discharge superheat of the expanded refrigerant introduced to the compressor is above a first predetermined valve, wherein the first refrigerant adjusting valve is closed when a condensing temperature of the first heat exchanger is above a third predetermined value.

8. A control method of an air conditioner, the method comprising:

measuring a degree of discharge superheat of a compressor;

expanding a portion of refrigerant that is branched off from refrigerant that flows from an indoor heat exchanger into an outdoor heat exchanger;

heat-exchanging the expanded portion of the refrigerant with the refrigerant that flows towards the outdoor heat exchanger; and introducing the heat-exchanged expanded portion of the refrigerant into the compressor, when a degree of discharge superheat is above a first predetermined value, wherein a degree of expanded portion of the refrigerant is adjusted such that the degree of discharge superheat of the compressor is above the first predetermined value, the air conditioner further comprising:

measuring a degree of superheat that corresponds to a temperature of the expanded portion of the refrigerant by the heat exchange; and adjusting a degree of the expanded refrigerant such that the degree of superheat reaches a second predetermined value.

9. The method according to claim 8, wherein the second predetermined value is set such that the degree of discharge superheat of the compress or is above the first predetermined value.

10. The method according to claim 8, wherein the second predetermined value is based on temperature of outdoor air.

11. A control method of an air conditioner, the method comprising:

measuring a degree of discharge superheat of a compressor;

expanding a portion of refrigerant that is branched off from refrigerant that flows from an indoor heat exchanger into an outdoor heat exchanger;

heat-exchanging the expanded portion of the refrigerant with the refrigerant that flows towards the outdoor heat exchanger;

introducing the heat-exchanged expanded portion of the refrigerant into the compressor, when a degree of discharge superheat is above a first predetermined value; and adjusting pressure of the refrigerant discharged by the compressor depending on a heating increase rate that corresponds to a ratio between a difference between the pressure of the refrigerant discharged by the compressor and the pressure of the refrigerant introduced into the compressor and a difference between the pressure of the refrigerant discharged by the compressor and the pressure of the expanded refrigerant introduced to the compressor.

12. The method according to claim 11, wherein the pressure of the refrigerant discharged by the compressor is adjusted such that the heating increase rate is within a predetermined range.

13. A control method of an air conditioner, the method comprising:

measuring a degree of discharge superheat of a compressor;

expanding a portion of refrigerant that is branched off from refrigerant that flows from an indoor heat exchanger into an outdoor heat exchanger;

heat-exchanging the expanded portion of the refrigerant with the refrigerant that flows towards the outdoor heat exchanger; and introducing the heat-exchanged expanded portion of the refrigerant into the compressor, when a degree of discharge superheat is above a first predetermined value, wherein a degree of expanded portion of the refrigerant is adjusted depending on a heating increase rate that corresponds to a ratio between a difference between the pressure of the refrigerant discharged by the compressor and the pressure of the refrigerant introduced into the compressor and a difference between the pressure of the refrigerant discharged by the compressor and the pressure of the expanded refrigerant introduced to the compressor.

14. The method according to claim 13, wherein the degree of expansion is adjusted such that the heating increase rate is within a predetermined range.

15. A control method of an air conditioner, the method comprising:

measuring a degree of discharge superheat of a compressor;

expanding a portion of refrigerant that is branched off from refrigerant that flows from an indoor heat exchanger into an outdoor heat exchanger;

heat-exchanging the expanded portion of the refrigerant with the refrigerant that flows towards the outdoor heat exchanger; and introducing the heat-exchanged expanded portion of the refrigerant into the compressor, when a degree of discharge superheat is above a first predetermined value, wherein when a condensing temperature of the first heat exchanger is above a third predetermined value, the refrigerant is not injected to the compressor any more.

* * * * *